US006679495B1

(12) United States Patent
Endelicato

(10) Patent No.: US 6,679,495 B1
(45) Date of Patent: Jan. 20, 2004

(54) GAME OF CHANCE

(76) Inventor: Marion Endelicato, 510 Oakmont Dr., Plattsmouth, NE (US) 68048

( * ) Notice: Subject to any disclaimer, the term of this patent is extended or adjusted under 35 U.S.C. 154(b) by 0 days.

(21) Appl. No.: 10/306,508

(22) Filed: Nov. 27, 2002

Related U.S. Application Data

(63) Continuation-in-part of application No. 09/729,183, filed on Dec. 5, 2000.
(60) Provisional application No. 60/169,520, filed on Dec. 7, 1999.

(51) Int. Cl.[7] ..... A63F 3/06
(52) U.S. Cl. ..... 273/269; 273/139; 273/274
(58) Field of Search ..... 463/16, 17, 18, 463/19, 20; 273/274, 269, 139; 283/903

(56) References Cited

U.S. PATENT DOCUMENTS 2,228,180 A * 1/1941 Pauli ..... 273/273
4,033,588 A * 7/1977 Watts ..... 463/18
4,364,567 A * 12/1982 Goott ..... 273/237
5,092,598 A * 3/1992 Kamille ..... 273/139
5,269,523 A * 12/1993 Boylan et al. ..... 273/138.1
5,273,281 A * 12/1993 Lovell ..... 273/138.1
5,303,929 A * 4/1994 Sandeen ..... 273/269
5,401,024 A * 3/1995 Simunek ..... 463/18
5,624,119 A * 4/1997 Leake ..... 273/269
5,788,240 A * 8/1998 Feinberg ..... 273/274
5,813,911 A * 9/1998 Margolin ..... 463/19
5,909,875 A * 6/1999 Weingardt ..... 273/269
5,935,001 A * 8/1999 Baba ..... 463/18
6,102,400 A * 8/2000 Scott et al. ..... 273/269
6,120,030 A * 9/2000 Chou ..... 273/284
6,315,291 B1 * 11/2001 Moody ..... 273/139

* cited by examiner

*Primary Examiner*—William M. Pierce
(74) *Attorney, Agent, or Firm*—James D. Welch

(57) ABSTRACT

Disclosed is a method of determining a winner in a game of chance involving four game areas of numbers. The winner is established based upon having placed a wager on numbers which are selected to appear in game areas three (302) and four (303), in accordance with a selected criteria which operate on numbers which are caused to be present in first (314) and second (315) game areas as a result of chance.

16 Claims, 5 Drawing Sheets

101

| | | | | | | | | | |
|---|---|---|---|---|---|---|---|---|---|
| 1 | 2 | 3 | 4 | 5 | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 | 34 | 35 | 36 | 37 | 38 | 39 | 40 |

102

| | | | | | | | | | |
|---|---|---|---|---|---|---|---|---|---|
| 41 | 42 | 43 | 44 | 45 | 46 | 47 | 48 | 49 | 50 |
| 51 | 52 | 53 | 54 | 55 | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |

PRIOR ART

FIG. 1

100

GAME OF CHANCE

This Application is a CIP of application Ser. No. 09/729,183 filed Dec. 5, 2000 and therevia Claims benefit of Provisional Application Ser. No. 60/169,520 Filed Dec. 7, 1999.

BACKGROUND OF THE INVENTION

1. Field of the Invention

The disclosed invention relates to games of chance generally, and more particularly to a game which involves four number containing game areas and in which game a winner is established based upon having placed a wager on numbers which are selected to appear in game areas three and four in accordance with a selected criteria which operate on numbers which are caused to be present in first and second game areas based upon chance.

2. Description of the Background Art

There are many types of games of chance that involve wagering on numbers, characters, or symbols to be drawn. Keno is one well known game of chance. In keno, players wager on which numbers will be drawn from a pool of eighty numbers (numbers 1–80). The draw order does not matter. Twenty numbers are typically drawn or selected by the gaming establishment. The more of those 20 numbers a player can match, the greater the winnings and payout. Other types of related games of chance are bingo and lotteries, for example.

FIG. 1 shows a prior art keno game area 100. The prior art keno game area 100 typically includes a first number matrix 101 that displays numbers 1 through 40 and a second number matrix 102 that displays numbers 41 through 80. Before each game, the players may wager on from one to generally twenty numbers, with varying payouts depending on the quantity of numbers wagered and the quantity that a player matches. The gaming establishment may set the payouts for the various draw quantities and matching quantities.

Keno, and other games of chance, can be played using paper tickets. In this version of the game, a player marks a ticket to indicate his or her number selections and then registers the ticket with a cashier. The ticket is then played against the next game displayed on a common board or number display, with each player playing one or more independent tickets. The display may show the twenty random numbers which were selected. In a common number draw setup, the numbers may be drawn using numbered ping pong balls (similar to a lottery). However, the numbers may also be electronically generated. The player then reviews his or her ticket and submits it to the cashier for any payout.

In an electronic version of a game of chance, a single layer plays against an electronic gaming machine for each round of the game and the player either wins or loses each round. The player wagers a coin, token or credit. The gaming machine displays the eighty number choices and accepts the player's number choices. Then the gaming machine randomly selects twenty numbers from the pool of eighty numbers and determines whether the player has achieved a winning payout.

Gaming types and variations have remained relatively unchanged over time. The existing games of chance continue to dominate, and new games or game variations have not appeared or caught on in any numbers. Established games such as blackjack, craps, roulette and baccarat are still widely played in an essentially unchanged form.

Some attempts have been made to provide more excitement and to obtain more frequent customers and more loyal customers by providing gaming devices which increase the player's odds of winning. These attempts have generally not been successful as they increase the complexity of the game. However, gaming establishments would like to attract a wider range of clientele, including persons who do not have gaming experience or who do not want to learn complicated and extensive rules.

What is needed, therefore, are improvements in games of chance.

SUMMARY OF THE INVENTION

A method of playing a game of chance is provided according to the invention. The method includes the steps of placing a wager and selecting, prior to a draw, a single item selection indicium representing single items in a game draw or selecting, prior to the draw, a multiple item selection indicium representing multiple items in a game draw. At least one single item or multiple item grouping is capable of being selected by a player as a wager of an item to be drawn in a predetermined draw occurrence.

A method of playing a game of chance is provided according to the invention. The method includes the steps of providing a plurality of single item selection indicia representing single items in a game draw and providing a plurality of multiple item selection indicia representing multiple items in a game draw. At least one of the plurality of single item selection indicia and the plurality of multiple item selection indicia are capable of being selected by a player in a game of chance prior to a draw as a wager of an item to be drawn in a predetermined draw occurrence.

A game of chance apparatus is provided according to the invention. The game of chance apparatus includes an item selection device and a game area. The game area includes a group of items representing all or part of a pool of items from which one or more items are drawn in a game of chance. The game area further includes a plurality of single item selection indicia disposed on the game area. Each single item selection indicium corresponds to an item of the game area. One or more indicium of the plurality of single item selection indicia may be selected by a player as a wager of an item to be drawn by the item selection device in a predetermined draw occurrence. The game area further includes a plurality of multiple item selection indicia disposed on the game area. Each multiple item selection indicium corresponds to a sub-group of two or more of the items of the game area. One or more indicium of the plurality of multiple item selection indicia may be selected by a player as a wager of an item to be drawn by the item selection device in the predetermined draw occurrence.

The disclosed invention can be further described as a method of determining a winner in a game of chance comprising the steps of:

a) providing four game areas, the first and third thereof comprising arbitrary numbers W–X and the second and forth thereof comprising arbitrary numbers Y–Z;

practicing steps b and c in either order:

b) having at least one person place a wager that at least one number in at least one of said third and forth game areas will be selected;

c) determining a criteria for selecting numbers in the third and forth game areas based on numbers selected in the first and second game areas;

d) selecting numbers in the first and second game areas based upon chance, and based upon said step c criteria for selecting numbers in the third and forth game areas, selecting numbers in said third and forth game areas based thereupon;

e) determining if a number wagered on by at least one person in at least one of said third and forth game areas in step b was selected in step d, and if so determining said at least one person who made said wager as a winner.

In keeping with KENO as a very relevant model, said method of determining a winner typically assigns:

W=1;

X=40;

Y=41; and

Z=80.

The step d selecting of numbers in the first and second game areas is preferably based on substantially random number generation from a game area of numbers from W–Z, however, the step d selecting of a number in the first game area can be based on substantially random number generation from a game area of numbers W–X and the step d selecting of a number in the second game area can be based on substantially random number generation from a game area of numbers Y–Z. Where W=1; X=40; Y=41; and Z=80 the step d selecting of a number in the first and second game areas is then typically based on substantially random number generation from a game area of numbers of 1–80 and preferred practice provides that the substantially random number generation is conducted without number replacement once a number is selected. An alternative approach provides that said method of determining a winner can provide that the step d selecting of a number in the first game area is based on substantially random number generation from a game area of numbers of 1–40; and wherein the step d selecting of a number in the second game area is based on substantially random number generation from a game area of numbers of 41–80, again preferably wherein substantially random number generation is conducted without number replacement once a number is selected.

While any functional criteria can be adopted, a preferred approach provides that the step c determined criteria for selecting numbers in the third and forth game areas based on numbers selected in the first and second game areas respectively, is that the first numbers selected in the first and second game areas based upon chance are entered directly to game areas three and four. An equally preferred approach provides that the last numbers selected in the first and second game areas based upon chance can also be entered directly to game areas three and four. Additional step c) a criteria for selecting numbers in the third and forth game areas based on numbers selected in the first and second game areas respectively, said criteria being selected from the group consisting of:

the first number selected by chance in said first game area and no number entered to said second game area;

the first number selected by chance in said second game area and no number entered to said first game area;

all numbers selected by chance in the range of (1–40) in said first game area and all numbers selected by chance in the range of (41–80) in said second game area;

the first number selected by chance in each of said first and second game areas is entered directly to the third and forth game areas respectively;

the Nth number selected in the range of (1–40) by chance in said first game area and the Nth number in the range (41–80) in said second game area are entered directly to the third and forth game areas respectively;

any number selected in the range of (1–40) by chance in said first game area and/or any number in the range (41–80) in said second game area is/are, based on random selection, entered directly to the third and forth game areas respectively;

d) selecting twenty (20) numbers based upon chance in the range (1–80) and distributing at least some of the N thereof which are in the range of (1–40) to said first game area and the at least some of the remaining (20–N) thereof which are in the range of (41–80) to said second game area, and based upon said step c criteria for selecting numbers in the third and forth game areas, selecting numbers in said third and forth game areas based upon said numbers caused to be present in said first and second game areas;

e) determining if a number wagered on by at least one person in at least one of said third and forth game areas in step b was selected in step d, and if so determining said at least one person who made said wager as a winner.

The above and other features and advantages of the present invention will be further understood from the following description of the preferred embodiments thereof, taken in conjunction with the accompanying drawings.

BRIEF DESCRIPTION OF THE DRAWINGS

FIG. 1 shows a prior art keno game area;

DETAILED DESCRIPTION OF THE PREFERRED EMBODIMENTS

Figure 2:
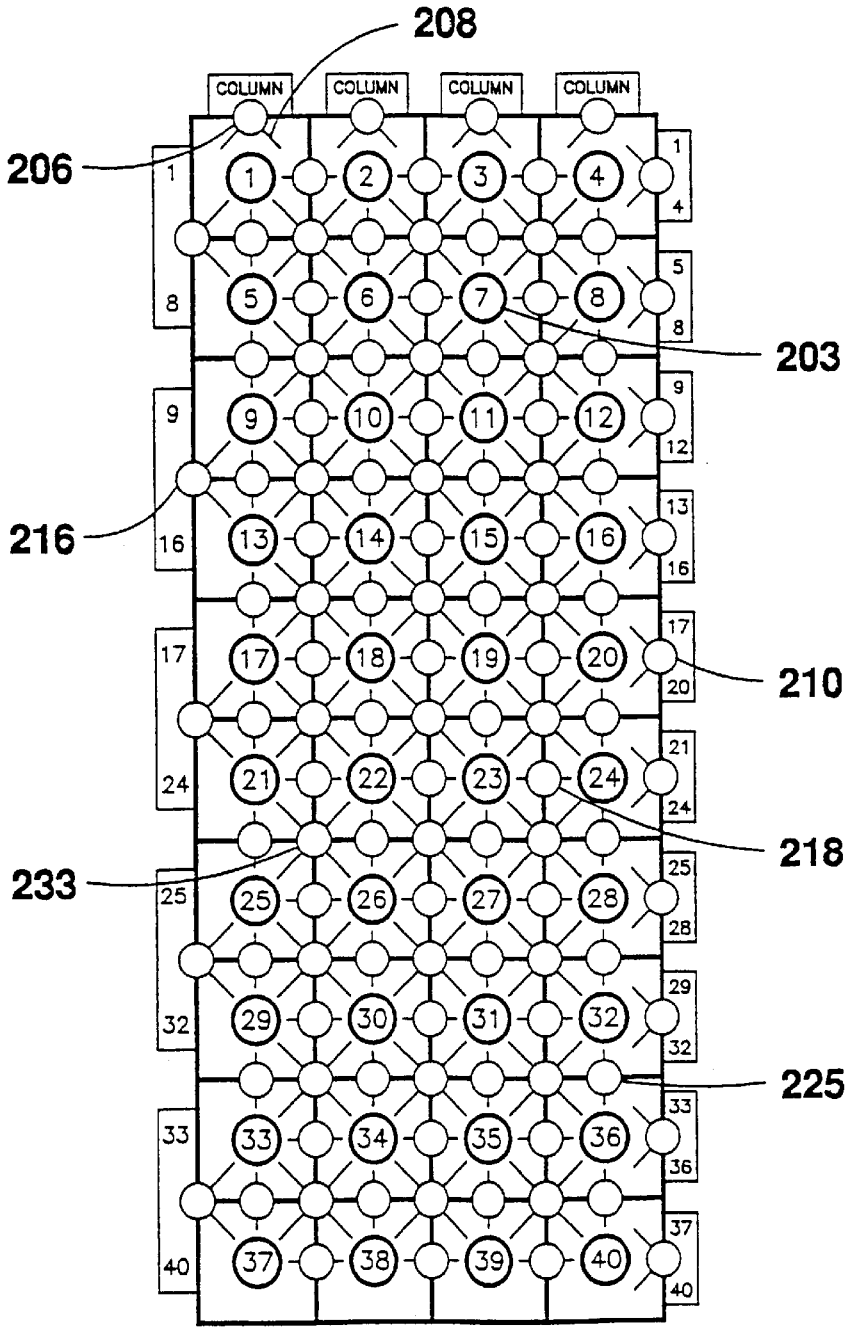
FIG. 2 shows a game area according to an embodiment of the intention.

FIG. 2 shows a game area 200 according to an embodiment of the invention. The game area 200 may be used for a keno game, for example, but may also be used for any game of chance that includes wagering on items such as numbers, characters, symbols, etc., drawn or generated at random. The discussion below concentrates on a keno game for simplicity.

The game area 200 includes items such as numbers, characters, or symbols. Numbers will be used below for simplicity. The game area 200 is an area in which a player may select individual numbers or groups of numbers before the keno game commences and before the official keno numbers are drawn or generated.

A draw for purposes of this disclosure is defined to be an item generated or drawn at random from a pool of items. It should be noted that although a draw is sometimes used in keno to designate a set of numbers selected from within the pool of 1–80 numbers, in this disclosure a draw or game draw is defined as an individual number of the set.

The game area 200 of the invention includes a plurality of single number selection indicia 203. Although the indicia are shown as being substantially circular, it should be understood that they may be of any suitable shape. The plurality of single item selection indicia 203 may be arranged substantially in a matrix for order and visual comprehension. A player may select any single number selection indicium 203. A wager of an item to be drawn in a predetermined draw occurrence is a wager on a potential winning number. For example, the player may bet on the number 10 to be drawn during a predetermined keno game draw occurrence. The player may place a wager by writing a wager amount in an appropriate selection indicium. If a player chooses a single number, the probability of matching a number drawn or generated in the predetermined keno draw occurrence is 1 out of 40 (for the game area 200, a drawn number is not used if it is from the 41–80 number set).

In addition to this, the game area 200 of the invention includes a plurality of multiple item selection indicia, with a multiple number selection indicium including indicator lines 208 that designates multiple numbers or groups of numbers that a player wishes to select. In one embodiment, the player may select only one indicium as his or her wager. In another embodiment, the player may select multiple indicia, including one or more multiple number selection indicium. In addition, a single number selection indicium 203 may be combined with any combination of multiple number selection indicia.

A first type of multiple number selection indicium is a column multiple number selection indicium 206. In a column multiple number selection indicium 206, an entire column of the game area may be selected. For example, if a player were to select the column multiple number selection indicium 206 above the leftmost column, the player would be selecting numbers 1-5-9-13-17-21-25-29-33-37, for example. An accompanying legend may specify the range of numbers included in the column, such as the above numbers. The probability of a winning number being drawn corresponding to a column multiple number selection indicium 206 is 1 out of 4.

A second type of multiple number selection indicium is the row (or line) multiple number selection indicium 210. This selects an entire row or line of numbers, such as numbers 17-18-19-20, for example. An accompanying legend may specify the range of numbers included in the row (i.e., numbers 17 through 20). The probability of a winning selection for a row multiple number selection indicium 210 is 1 out of 10.

A third type of multiple number selection indicium is the double row multiple number selection indicium 216 that selects two adjacent rows or lines. This may be referred to as an octal bet since eight numbers are chosen. For example, this may choose numbers 9-10-11-12-13-14-15-16. An accompanying legend may specify the range of numbers included in the row (i.e., numbers 1 through 8, numbers 9 through 16, etc.). The probability of a winning selection for a double row multiple number selection indicium 216 is 1 out of 5.

A fourth type of multiple number selection indicium is the two horizontally adjacent multiple number selection indicium 218 that selects two horizontally adjacent numbers (a dual bet), such as numbers 23–24, for example. Alternatively, a player may select a vertically adjacent multiple number selection indicium 225 that selects vertically adjacent numbers (a dual bet), such as 32–36, for example. The probability of a winning selection for a horizontally adjacent multiple number selection indicium 218 or a vertically adjacent multiple number selection indicium 225 is 1 out of 20.

A fifth type of multiple number selection indicium is the four adjacent multiple number selection indicium 233 (a four-corner bet). The four adjacent multiple number selection indicium 233 is in the middle of a grid of four numbers, such as numbers 21-22-25-26, for example. The probability of a winning selection for a four adjacent multiple number selection indicium 233 is 1 out of 10.

The game area 200 of the present invention is designed to provide greater excitement and variation of play. This is done without creating more complicated rules. In addition, the multiple number selections are visually self-explanatory and simple. Both experienced and novice keno players can look at the game area 200 and pick either a single or multiple number selection indicium in order to play a keno game.

It should be noted that although only one game area 200 is shown, two game areas could be provided, with a first one covering numbers 1–40 and the second one covering numbers 41–80. It should also be noted that the game area 200 could also include a traditional keno game area 100 to allow simultaneous play of the game of the invention and a traditional keno game.

To play a game utilizing the game area 200 of the invention, a player preferably makes a single choice on the game area 200. The player also wagers an amount. If the player chooses a single number, he or she is wagering that he or she is capable of guessing the winning number that will be drawn during a predetermined keno draw occurrence. By using the game area 200, the player can wager that a single number will be drawn, or may select from a number grouping in order to wager that the number drawn will be within this number grouping.

For example, the player can wager that the predetermined keno draw occurrence will yield a 20. If the number actually drawn is the number 20, the player wins and collects money. If the number actually drawn is not the number 20, the player loses. In another example, the player can select a row multiple number selection indicium 210, including numbers 17 through 20. If the actual number drawn is a 17, 18, 19, or 20, the player wins. Therefore, the player has a greater chance of winning if he or she selects one of the multiple number selection indicia. However, the payout may be correspondingly lower. This will be offset by the increased likelihood and frequency of winning.

After a wagering period is concluded, the game numbers are generated and generally displayed to the players. The number draws may be performed by a number selection device (not shown). The number selection device may be any device that is capable of randomly drawing the numbers from a pool or randomly generating the numbers. The number selection device may be a pneumatic device that selects numbered balls; may be a rotating drum that dispenses numbered chips or tokens, may be an electronic device that contains a random number generator and electronic display, etc.

One embodiment of the game area 200 is on a keno ticket. A keno ticket is typically a card or paper on which a player can indicate number choices. The number choices may be indicated by putting a wager amount in the selection area or areas. When the player has completed the keno ticket, the ticket may be submitted to a cashier who accepts a wager amount and validates the ticket. The cashier keeps a record of the wager transaction and issues a receipt (or validates the ticket). The keno game may then be initiated by the gaming establishment. The gaming establishment draws or generates numbers and displays them to the players. If a player believes he or she has a winning ticket, it is submitted to the gaming establishment in order to receive a payout.

In another embodiment, the game area 200 may be created and displayed on an electronic gaming terminal. The electronic gaming terminal typically conducts a one-on-one game with the keno player. The electronic gaming terminal may include a display for showing the game area 200 and at least one input device for making at least one selection from the game area 200. The input device may be, for example, a keyboard, keypad, or touch screen. Using the display and the at least one input device, the player may select a desired indicium or indicia and initiate a keno number draw. The terminal then generates a set of numbers that are presented to the player. This provides a faster paced game that may be more suited to individual players instead of having to wait for a large group to submit their plays and wait for a number generation. The faster pace may provide greater revenue for the gaming establishment.

Typically, an electronic gaming terminal is a stand-alone device having complete electronics, including a keyboard or other input and a display or other output through which a player can enter his or her selections and view the game. The electronic terminal may contain its own processor and memory and may store the player's selections and generate numbers. Alternatively, in a less preferred embodiment, the electronic gaming terminal may be a terminal that communicates with a central gaming server, with the central gaming server generating the numbers and relaying them to a number of terminals.

In one embodiment, the play in the game area 200 will commence with a first individual number draw occurrence of a keno game. If, for example, the first number drawn is 31, a player will win if the number 31 is included in his or her number selection; such as row or column selections or two or four adjacent number selections. If a number other than a number in the range of 1 through 40 is drawn, the particular game will not be triggered until a number 1 through 40 is drawn, such as a first 1–40 occurrence in a subsequent individual number draw.

Alternatively, any predetermined individual number draw during a keno game could be used. For example, before starting a keno game, a separate machine or procedure may draw or generate a number that says the fifth number drawn will be the winning number to be used on the game area 200. Alternatively, the last number drawn could be the winning number for that game.

Selecting the last number drawn would add more excitement and anticipation to the game. In addition, any number of selected wagers may be placed, and a separate game area 200 may be used for each individual wager. In yet another embodiment, more than one wager may be marked on a game area 200. For example, several predetermined wagering combinations may be played on the game area 200 during a keno game, adding more excitement to the keno game.

Figure 3:
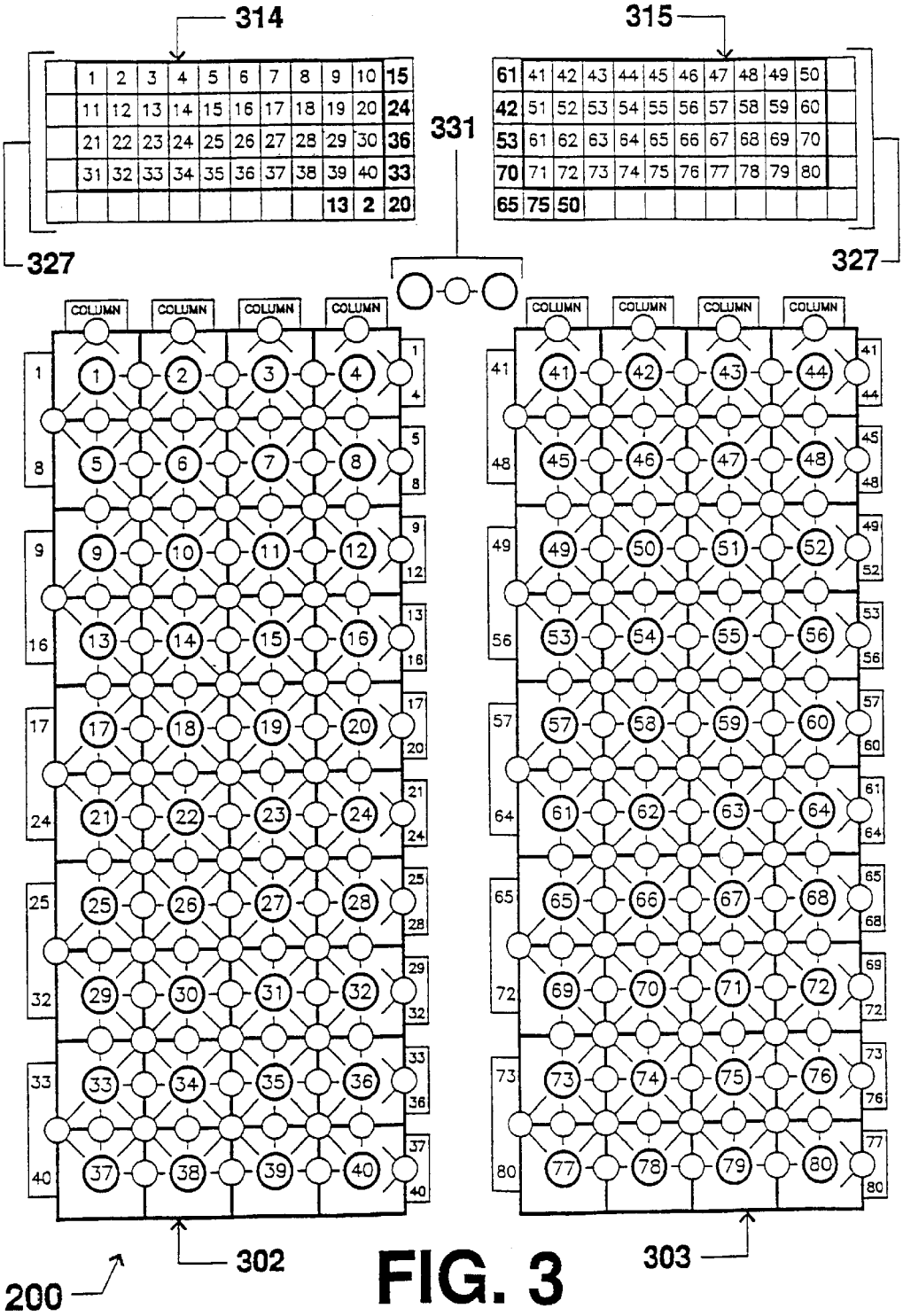
FIG. 3 shows first 314, second 315, third 302 and forth 304 game areas.

FIG. 3 shows another embodiment of the game area 200. In this embodiment, two matrix sets 302 and 303 are included in the game area 200, including all numbers 1 through 80. In addition, in this embodiment the game area 200 includes areas 314 and 315 and a double wager selector 331.

In this embodiment, a player may wager on a winning number from the numbers 1–40, the numbers 41–80, or all numbers 1–80. A player may play matrix 302, matrix 303, or both.

The double wager selector 331 may be used to wager on both the winning number in the matrix 302 and on the winning number in the matrix 303. A player may select a number from the matrix 302 (from numbers 1–40) and may write that number in the left selection indicium. The player may also select a number from the matrix 303 (from numbers 41–80) and may write that number in the right selection indicium. The player may then write a wager amount in the center indicium to complete the wager. In order to win this wager, the player must correctly select the winner of both matrix 302 and matrix 303. For example, if the player wishes to wager that the numbers 18 and 52 will be drawn as the winning numbers, the player may write the numbers 18 and 52 in the respective left and right selection indicia and a wager amount in the center indicium.

The areas 314 and 315 also display numbers 1 through 40 and 41 through 80. These are the traditional keno playing areas. A player may therefore play the keno game according to the invention, while also participating or tracking a traditional keno game. The player may use the numbers of areas 314 and 315 to place traditional keno wagers (by circling numbers or drawing an X on numbers, for example).

The areas 314 and 315 include empty perimeter cells 327, which may be used to show the individual numbers drawn during play. Each drawn number may be recorded in the cells 327 in the order or sequence that they are drawn. In an electronic embodiment, a display or official game area would record all of the numbers as they are drawn or generated. Players can refer to this official house number sequence display and use the display to determine if he or she is a winner. It is preferred that the numbers are recorded in the order that they are drawn or generated, as a particular draw occurrence may be pre-designated as the winning number for play in the matrix 302 or in the matrix 303. In a preferred embodiment, either the first draw occurrence or the last draw occurrence for each game area 302 and 303 will be used for the respective areas 314 and 315. Therefore, for example, for the draw sequence shown in area 314, the upper rightmost cell may contain the first number drawn and subsequent numbers are recorded in a downward and to the left fashion in the cells 327. In the example shown, the numbers drawn so far are 15-24-36-33-20-2-13. If a number in the range 41–80 is drawn, it will be recorded in the area 315. It should be understood that the upper leftmost cell of the cells 327 may alternately represent the first number drawn. Similarly, the upper leftmost cell of area 315 contains the first number drawn from the numbers 41–80 and subsequent numbers in area 315 are recorded in a downward and to the right fashion in the cells 327. In the example shown, the numbers drawn so far are 61, 42, 53, 70, 65, 73, and 50. In the example shown, assuming the number 15 is the first number drawn by chance in the first area 314, the number 15 will be the winning number for the third game area 302. Similarly, if the number 61 is the first number drawn by chance in second game area 315, then the number 61 will be the winning number for the forth game area 303.

It should be noted that the order shown is arbitrary, and the gaming establishment may determine how the drawn numbers will be ordered and displayed.

It should be further noted that any cell (or corresponding position in the draw sequence) may be designated as the number to be used in the matrix 302 or in the matrix 303. For example, a fifth number drawn could be the number to be played. Any type of indicator or symbol, border, arrow, etc., may be used to designate the cell to contain the winning number. In an electronic embodiment, the active cell may light up, flash, etc., in order to designate the winning number (i.e., the number to be played).

Figure 4:
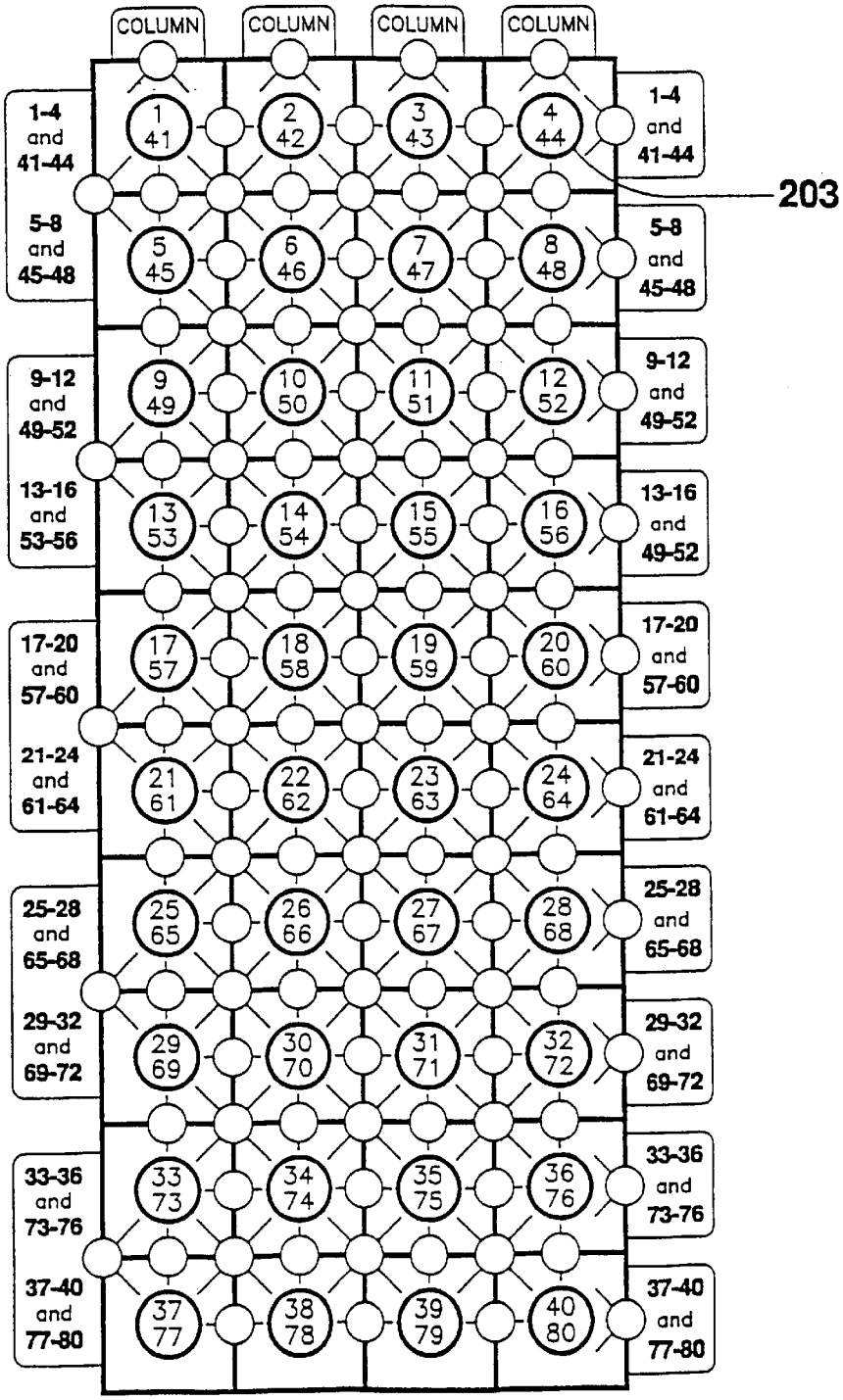
FIG. 4 shows yet another embodiment of the game area.

FIG. 4 shows yet another embodiment of the game area 200 wherein all eighty numbers are contained within a single matrix. Each single number selection indicium 203 therefore contains two numbers, one from the 1–40 number set and one from the 41–80 number set. In this embodiment, the player will win if he or she wagered on the number 4 and either 4 or 44 was drawn. The payouts may be the same as the payouts in the game area 200 of FIG. 2.

Figure 5:
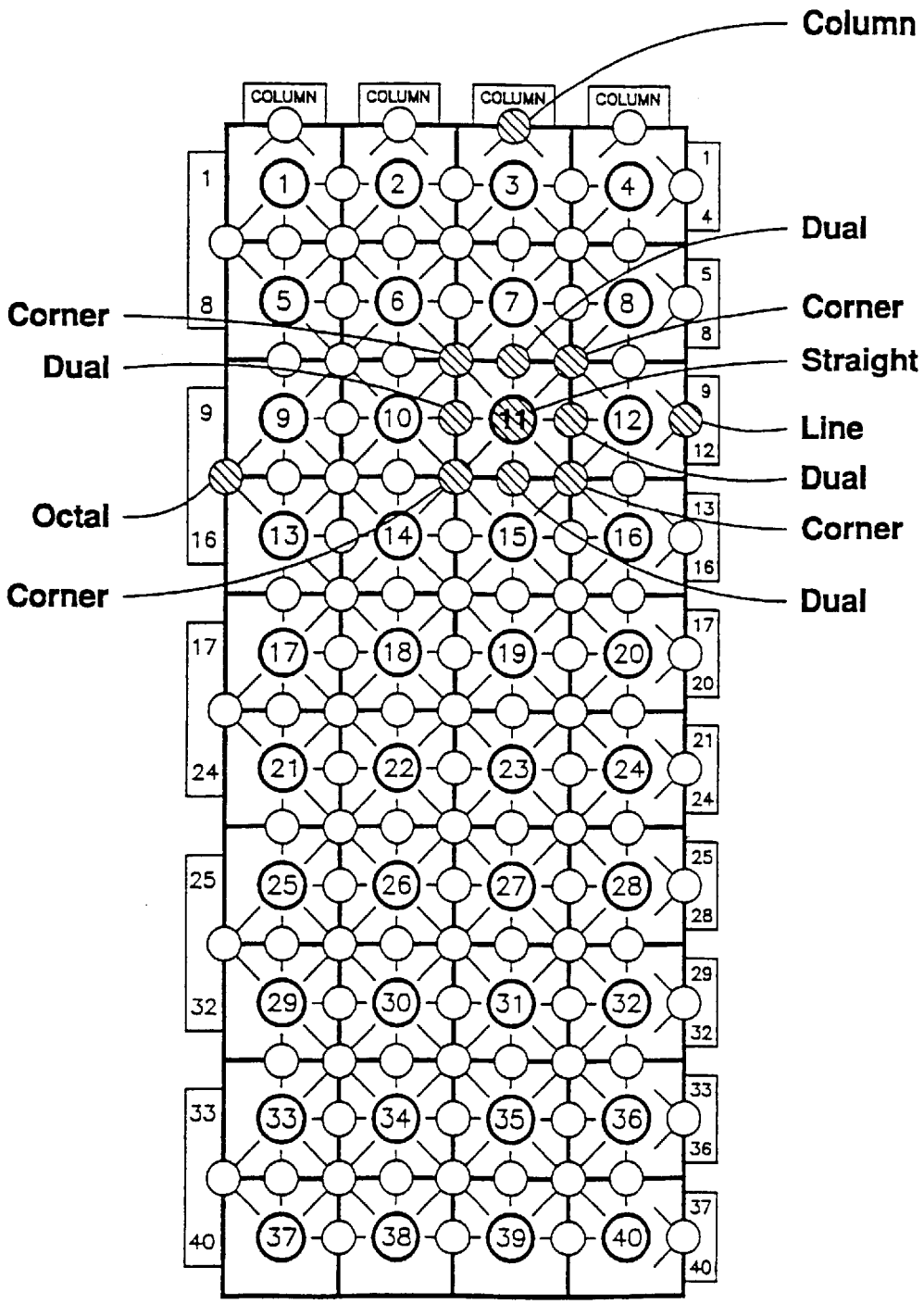
FIG. 5 shows the game area wherein all possible winning wagers are indicated for a winning number of 11.

FIG. 5 shows the game area 200 wherein all possible winning wagers are indicated for a winning number of 11. In the electronic embodiment, after the winning number has been generated or selected, the gaming terminal may light up or otherwise indicate all possible winning number selections, including multiple number selection wagers. Likewise, an electronic display in a gaming establishment may in some manner indicate to the players all possible winning combinations that may be possible for the winning number. In this example, the number 11 is the winning number. Therefore, a player may win if he or she placed a wager on the individual (straight) number wager 11, the dual wagers 7-11, 10-11, 11-12, and 11-15, the row or line wager 9-10-11-12, the column wager 3-7-11-15-19-23-27-31-35-39, the corner wagers 6-7-10-11, 7-8-11-12, 10-11-14-15, and 11-12-15-16, or the octal or double row wager 9-10-11-12-13-14-15-16.

In a first method embodiment according to the invention, the first step comprises placing a wager. The second step comprises selecting a single item selection indicium representing single items in a game draw or a multiple item selection indicium representing multiple items in a game draw. A single item or a multiple item grouping may be selected by a player as a wager of an item (such as a winning number) to be drawn in a predetermined draw occurrence. Using a multiple item selection indicium, the player may wager that an item within an item grouping will be drawn. This, of course, will generally result in a lower payoff, as the odds of drawing into a grouping will be greater than the drawing of an individual item. The payout may be accordingly adjusted by the gaming establishment.

In a second method embodiment according to the invention, a plurality of single item selection indicia representing single items in a game draw are provided. Furthermore, a plurality of multiple item selection indicia representing multiple items in a game draw are provided. At least one of the single items and the multiple item groupings may be selected by a player prior to a draw as a wager of an item to be drawn in a predetermined draw occurrence. Moreover, a player may select any combination of single item selection indicia and multiple item selection indicia.

While the invention has been described in detail above, the invention is not intended to be limited to the specific embodiments as described. It is evident that those skilled in the art may now make numerous uses and modifications of and departures from the specific embodiments described herein without departing from the inventive concepts.

I claim:

1. A method of determining a winner in a game of chance comprising the steps of:

a) providing four game areas, the first and third thereof comprising arbitrary numbers W–X and the second and forth thereof comprising arbitrary numbers Y–Z;

practicing steps b and c in either order:

b) having at least one person place a wager that, at least one number in at least one of said third and forth game areas will be selected;

c) determining a criteria for selecting numbers in the third and forth game areas based on numbers selected in the first and second game areas;

d) selecting numbers in the first and second game areas based upon chance, and based upon said step c criteria for selecting numbers in the third and forth game areas, selecting numbers in said third and forth game areas based thereupon;

e) determining if a number wagered on by at least one person in at least one of said third and forth game areas in step b was selected in step d, and if so determining said at least one person who made said wager as a winner.

2. A method of determining a winner as in claim 1 wherein:

W=1;

X=40;

Y=41; and

Z=80.

3. A method of determining a winner as in claim 1 wherein the step d selecting of numbers in the first and second game areas is based on substantially random number generation from a game area of numbers from W–Z.

4. A method of determining a winner as in claim 1 wherein wherein the step d selecting of a number in the first game area is based on substantially random number generation from a game area of numbers W–X; and wherein the step d selecting of a number in the second game area is based on substantially random number generation from a game area of numbers Y–Z.

5. A method of determining a winner as in claim 2 wherein the step d selecting of a number in the first and second game areas is based on substantially random number generation from a game area of numbers of 1–80.

6. A method of determining a winner as in claim 5 wherein substantially random number generation is conducted without number replacement once selected.

7. A method of determining a winner as in claim 2 wherein the step d selecting of a number in the first game area is based on substantially random number generation from a game area of numbers of 1–40; and wherein the step d selecting of a number in the second game area is based on substantially random number generation from a game area of numbers of 41–80.

8. A method of determining a winner as in claim 7 wherein substantially random number generation is conducted without number replacement once selected.

9. A method of determining a winner as in claim 1, in which the step c determined criteria for selecting numbers in the third and forth game areas based on numbers selected in the first and second game areas respectively, is that the first numbers selected in the first and second game areas based upon chance are entered directly to game areas three and four.

10. A method of determining a winner as in claim 2, in which the step c determined criteria for selecting numbers in the third and forth game areas based on numbers selected in the first and second game areas respectively, is that the first numbers selected in the first and second game areas based upon chance are entered directly to game areas three and four.

11. A method of determining a winner as in claim 1, in which the step c determined criteria for selecting numbers in the third and forth game areas based on numbers selected in the first and second game areas respectively, is that the last numbers selected in the first and second game areas based upon chance are entered directly to game areas three and four.

12. A method of determining a winner as in claim 2, in which the step c determined criteria for selecting numbers in the third and forth game areas based on numbers selected in the first and second game areas respectively, is that the last numbers selected in the first and second game areas based upon chance are entered directly to game areas three and four.

13. A method of determining a winner as in claim 1, in which the step c determined criteria for selecting numbers in the third and forth game areas based on numbers selected in the first and second game areas respectively, is based on a criteria other than entering the first or last numbers selected in the first and second game areas based upon chance to said game areas three and four.

14. A method of determining a winner as in claim 2, in which the step c determined criteria for selecting numbers in the third and forth game areas based on numbers selected in the first and second game areas respectively, is based on a criteria other than entering the first or last numbers selected in the first and second game areas based upon chance to said game areas three and four.

15. A method of determining a winner in a game of chance comprising the steps of:

a) providing four game areas, the first and third thereof comprising numbers 1–40 and the second and forth thereof comprising numbers 41–80;

practicing steps b and c in either order:

b) having at least one person place a wager that at least one number in at least one of said third and forth game areas will be selected;

c) determining a criteria for selecting numbers in the third and forth game areas based on numbers selected in the first and second game areas respectively, said criteria being selected from the group consisting of:

the first number selected by chance in each of said first and second game areas is entered directly to the third and forth game areas respectively;

the last number selected by chance in each of said first and second game areas is entered directly to the third and forth game areas respectively;

d) selecting numbers in the first and second game areas based upon chance, and based upon said step c criteria for selecting numbers in the third and forth game areas, selecting numbers in said third and forth game areas based thereupon;

e) determining if a number wagered on by at least one person in at least one of said third and forth game areas in step b was selected in step d, and if so determining said at least one person who made said wager as a winner.

16. A method of determining a winner in a game of chance comprising the steps of:

a) providing four game areas, the first and third thereof comprising numbers 1–40 and the second and forth thereof comprising numbers 41–80;

practicing steps b and c in either order:

b) having at least one person place a wager that at least one number in at least one of said third and forth game areas will be selected;

c) determining a criteria for selecting numbers in the third and forth game areas based on numbers selected in the first and second game areas respectively, said criteria being selected from the group consisting of:

the first number selected by chance in said first game area and no number entered to said second game area;

the first number selected by chance in said second game area and no number entered to said first game area;

all numbers selected by chance in the range of (1–40) in said first game area and all numbers selected by chance in the range of (41–80) in said second game area;

the first number selected by chance in each of said first and second game areas is entered directly to the third and forth game areas respectively;

the Nth number selected in the range of (1–40) by chance in said first game area and the Nth number in the range (41–80) in said second game area are entered directly to the third and forth game areas respectively;

any number selected in the range of (1–40) by chance in said first game area and/or any number in the range (41–80) in said second game area is/are, based on random selection, entered directly to the third and forth game areas respectively;

d) selecting twenty (20) numbers based upon chance in the range (1–80) and distributing at least some of the N thereof which are in the range of (1–40) to said first game area and the at least some of the remaining (20–N) thereof which are in the range of (41–80) to said second game area, and based upon said step c criteria for selecting numbers in the third and forth game areas, selecting numbers in said third and forth game areas based upon said numbers caused to be present in said first and second game areas;

e) determining if a number wagered on by at least one person in at least one of said third and forth game areas in step b was selected in step d, and if so determining said at least one person who made said wager as a winner.

* * * * *